US007793440B1

(12) United States Patent
Ropog

(10) Patent No.: US 7,793,440 B1
(45) Date of Patent: Sep. 14, 2010

(54) METHOD AND APPARATUS FOR ATTACHING A MOLDBOARD TO A MOLDBOARD FRAME

(75) Inventor: Jim Ropog, North Olmsted, OH (US)

(73) Assignee: Louis Berkman Winter Products Company, Cleveland, OH (US)

( * ) Notice: Subject to any disclaimer, the term of this patent is extended or adjusted under 35 U.S.C. 154(b) by 0 days.

(21) Appl. No.: 12/543,824

(22) Filed: Aug. 19, 2009

(51) Int. Cl.
*E01H 5/06* (2006.01)

(52) U.S. Cl. ..... 37/266; 37/233

(58) Field of Classification Search ..... 37/232, 37/233, 196, 264, 266, 270, 466, 274–283; 172/264–266, 820, 832, 701.1, 822, 823
See application file for complete search history.

(56) References Cited

U.S. PATENT DOCUMENTS 3,465,456 A * 9/1969 Meyer ..... 37/233
3,994,081 A * 11/1976 Middleton ..... 37/273
4,231,216 A * 11/1980 Weber ..... 56/13.6
4,574,502 A 3/1986 Blau
4,803,790 A 2/1989 Ciula
4,837,951 A 6/1989 Verseef
4,844,195 A * 7/1989 Deli et al. ..... 180/9.5
4,845,866 A * 7/1989 Ciula ..... 37/266
5,018,284 A 5/1991 Mikami et al.
5,079,866 A 1/1992 Farrell
5,088,215 A 2/1992 Ciula
5,477,600 A 12/1995 Houle et al.
5,692,855 A * 12/1997 Burton ..... 403/325
6,564,479 B1 5/2003 Vickers

* cited by examiner

*Primary Examiner*—Robert E Pezzuto
(74) *Attorney, Agent, or Firm*—Emerson Thomson Bennett; Roger D. Emerson; Timothy D. Bennett

(57) ABSTRACT

A snowplow assembly may include a moldboard frame and a moldboard. The moldboard frame may include an angle member operatively connected to a top member, wherein a space is defined between the angle member and the top member. The moldboard frame may also include a first stop member. The moldboard may include a first recess near a top portion of the moldboard. The top portion of the moldboard is positioned within the space between the angle member and the top member. The first stop member is positioned in the first recess.

20 Claims, 5 Drawing Sheets

DETAIL A

METHOD AND APPARATUS FOR ATTACHING A MOLDBOARD TO A MOLDBOARD FRAME

I. BACKGROUND OF THE INVENTION

A. Field of Invention

This invention relates generally to snowplows and more specifically to attaching a moldboard to a moldboard frame.

B. Description of the Related Art

It is well known in the art to provide a snowplow on the front of a vehicle for displacing snow, sleet, ice and the like along a roadway, driveway or other ground surface. Generally, a snowplow assembly will include a plow blade that is used to contact the snow and a mount assembly that is used to mount the snowplow mechanism to the vehicle. Many snowplow assemblies pivotally attach the plow blade to the mount assembly allowing the blade to pivot about a vertical pivot axis and direct plowed snow to either side of the vehicle path. The mount assemblies are often pivotally attached to a vehicle for selectively raising and lowering the snowplow assembly using hydraulic controls located in the vehicle. The plow blade may also be pivotally attached to the mount assembly allowing the plow blade (or a portion of the blade) to pivot about a horizontal mounting axis. Springs may connect between the plow blade and the mount assembly for biasing the plow blade in an upright position and for dampening the rotational movement about the horizontal mounting axis when the plow blade encounters an obstacle. The plow blade may include a plastic moldboard attached to a metal moldboard frame.

While known plow blades generally work well for their intended purpose, they have disadvantages. One disadvantage is that known plastic moldboards can have undesired movement relative to the moldboard frame during operation of the snowplow. Another problem is that known plastic moldboards can be difficult to install and replace. Therefore, what is needed is a plow blade assembly that resolves these disadvantages.

II. SUMMARY OF THE INVENTION

According to one embodiment of this invention, a snowplow assembly comprises a moldboard and a moldboard frame. The moldboard frame comprises a substantially horizontal top member defining a top of the moldboard frame; a substantially horizontal bottom member defining a bottom of the moldboard frame, the bottom member spaced apart from the top member; a plurality of spaced apart rib members having a first end fixedly attached to the top member and a second end fixedly attached to the bottom member; an angle member operatively connected to the top member, wherein a space is defined between a first portion of the angle member and the top member; and, a first stop member operatively connected to the angle member. The moldboard comprises a first recess near a top portion of the moldboard, and a longitudinal axis, a first transverse axis, and a second transverse axis substantially perpendicular to the first transverse axis. The top portion of the moldboard may be positioned within the space between the first portion of the angle member and the top member for maintaining the position of the moldboard along the first transverse axis in relation to the moldboard frame. The first stop member may be positioned in the first recess for maintaining the position of the moldboard along the longitudinal axis in relation to the moldboard frame. A bottom portion of the moldboard may be operatively attached to the bottom plate for maintaining the position of the moldboard along the second transverse axis in relation to the moldboard frame.

According to another embodiment this invention, a snowplow assembly comprises a moldboard formed of polyethylene and a moldboard frame. The moldboard frame comprises a substantially horizontal top member defining a top of the moldboard frame; a substantially horizontal bottom member defining a bottom of the moldboard frame, the bottom member spaced apart from the top member; a plurality of spaced apart rib members having a first end fixedly attached to the top member and a second end fixedly attached to the bottom member; an angle member operatively connected to the top member, wherein a space is defined between a first portion of the angle member and the top member, and wherein a transverse axis of the first portion is substantially parallel to a transverse axis of the top member; a first stop member fixedly attached to a first end of the first portion of the angle member; and a second stop member fixedly attached to a second end of the first portion of the angle member. The moldboard frame comprises first and second recesses near a top portion of the moldboard; a first curvilinear edge and a spaced apart second curvilinear edge, wherein the first curvilinear edge includes the first recess and the second curvilinear edge includes the second recess; and a longitudinal axis, a first transverse axis, and a second transverse axis substantially perpendicular to the first transverse axis. The top portion of the moldboard may be positioned within the space between a first portion of the angle member and the top member for maintaining the position of the moldboard along the first transverse axis in relation to the moldboard frame. The first stop member may be positioned in the first recess for maintaining the position of the moldboard along the longitudinal axis in relation to the moldboard frame. The second stop member may be positioned in the second recess for maintaining the position of the moldboard along the longitudinal axis in relation to the moldboard frame. A bottom portion of the moldboard may be operatively attached to the bottom plate for maintaining the position of the moldboard along the second transverse axis in relation to the moldboard frame.

According to another embodiment this invention, a method comprises the steps of providing a moldboard frame including a substantially horizontal top member defining a top of the moldboard frame, a substantially horizontal bottom member defining a bottom of the moldboard frame, the bottom member spaced apart from the top member, a plurality of spaced apart rib members having a first end fixedly attached to the top member and a second end fixedly attached to the bottom member, an angle member operatively connected to the top member, wherein a space is defined between a first portion of the angle member and the top member, and a first stop member operatively connected to the angle member; providing a moldboard formed of polyethylene, the moldboard including a first recess near a top portion of the moldboard, a longitudinal axis, a first transverse axis, and a second transverse axis substantially perpendicular to the first transverse axis; inserting the top portion of the moldboard within the space between the first portion of the angle member and the top member for maintaining the position of the moldboard along the first transverse axis in relation to the moldboard frame; positioning the top portion of the moldboard so that the first stop member is located within the first recess for maintaining the position of the moldboard along the longitudinal axis in relation to the moldboard frame; and attaching a bottom portion of the moldboard to the bottom plate for maintaining the position of the moldboard along the second transverse axis in relation to the moldboard frame.

One advantage of this invention is that the relative movement between the moldboard and the moldboard frame is eliminated.

Another advantage of this invention is the ease of replacement of moldboards.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

Figure 7B:
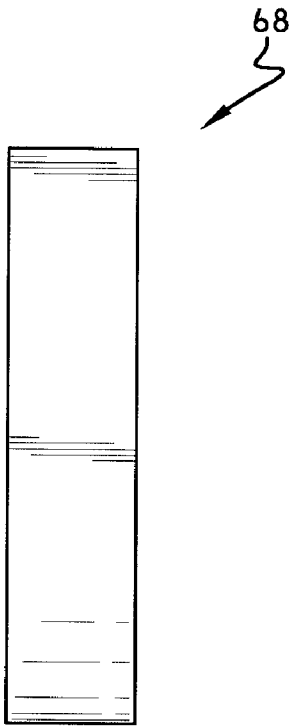
Figure 7A:
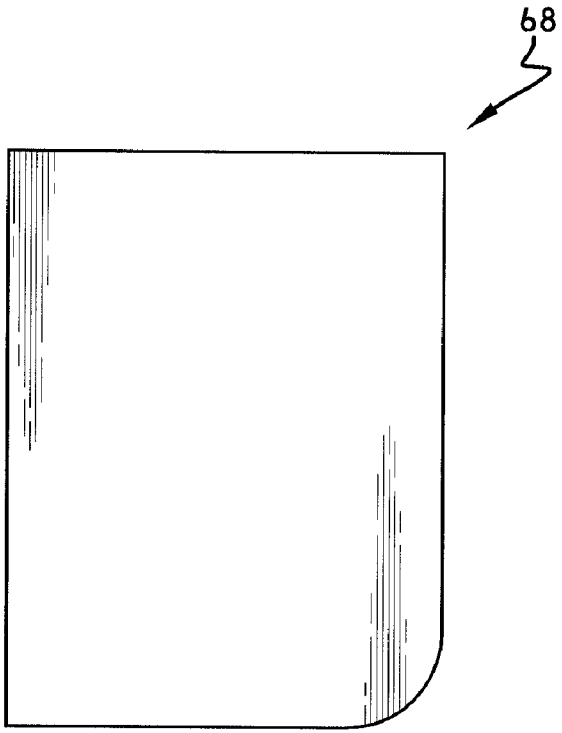

FIG. 7*a* is a front view of a stop member.

FIG. 7*b* is a side view of the stop member shown in FIG. 7*a*.

Figure 8:
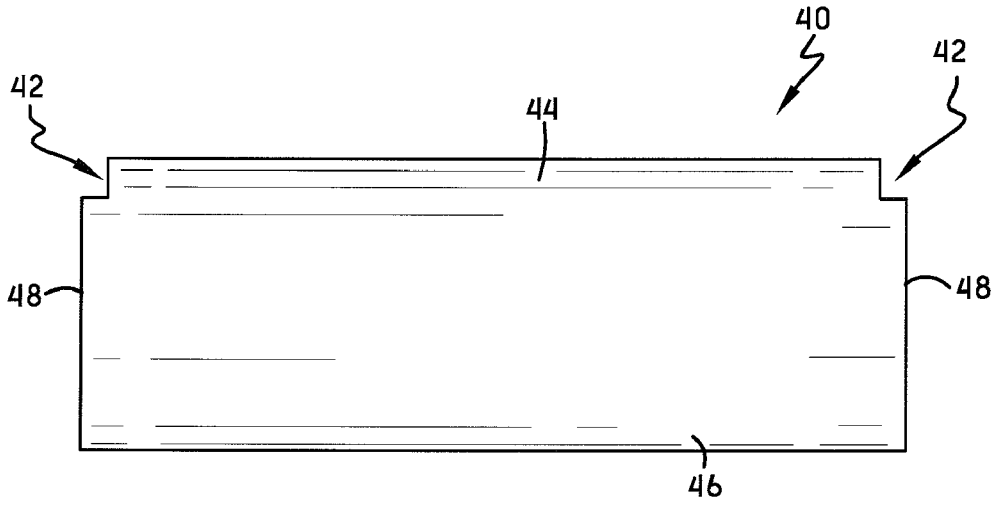

FIG. 8 is a front view of a moldboard.

Figure 9:
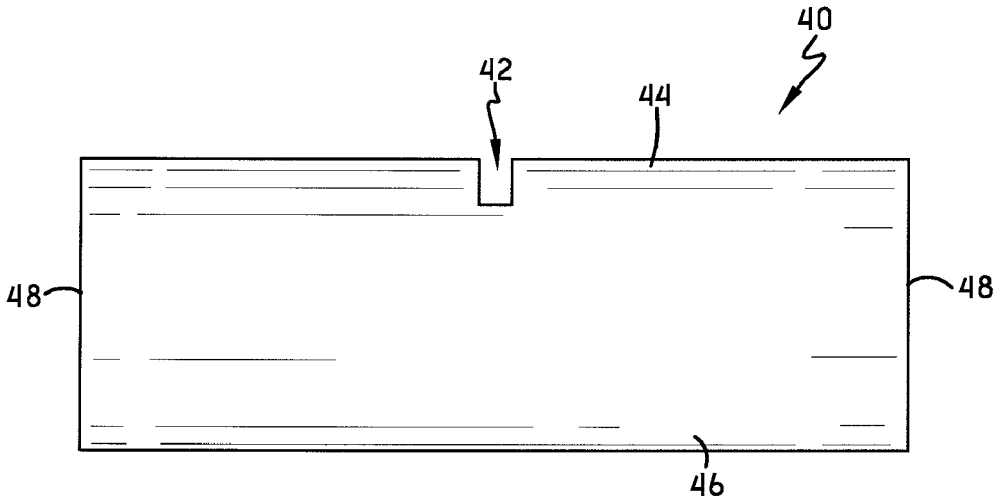

FIG. 9 is a front view of a moldboard in another embodiment.

IV. DETAILED DESCRIPTION OF THE INVENTION

Figure 1:
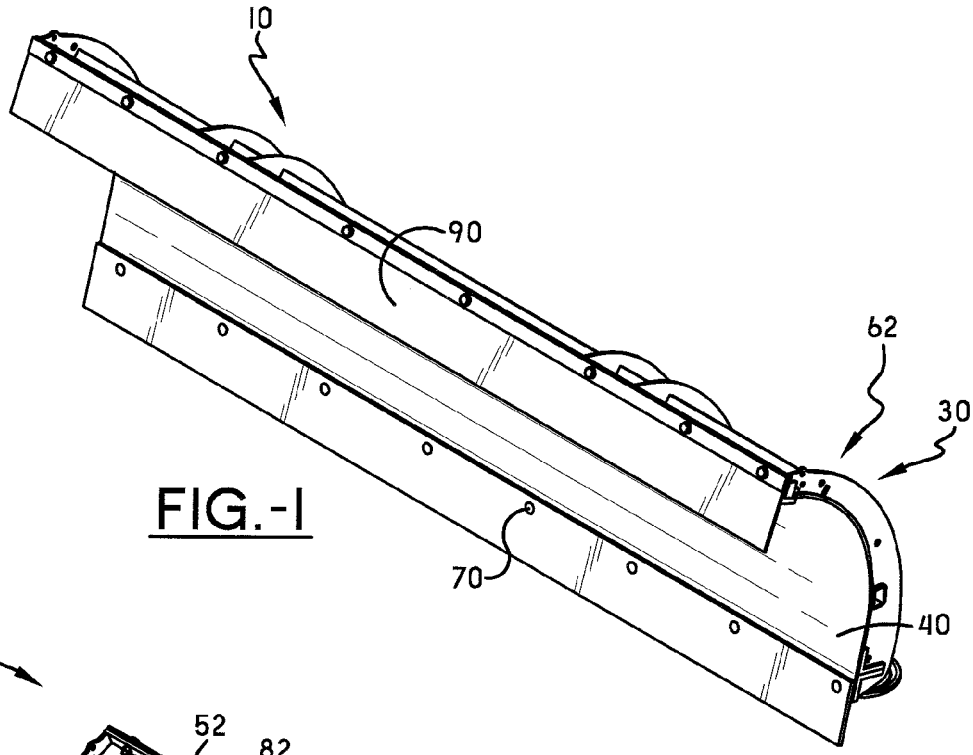
FIG. 1 is a front perspective view of a snowplow assembly.
Figure 2:
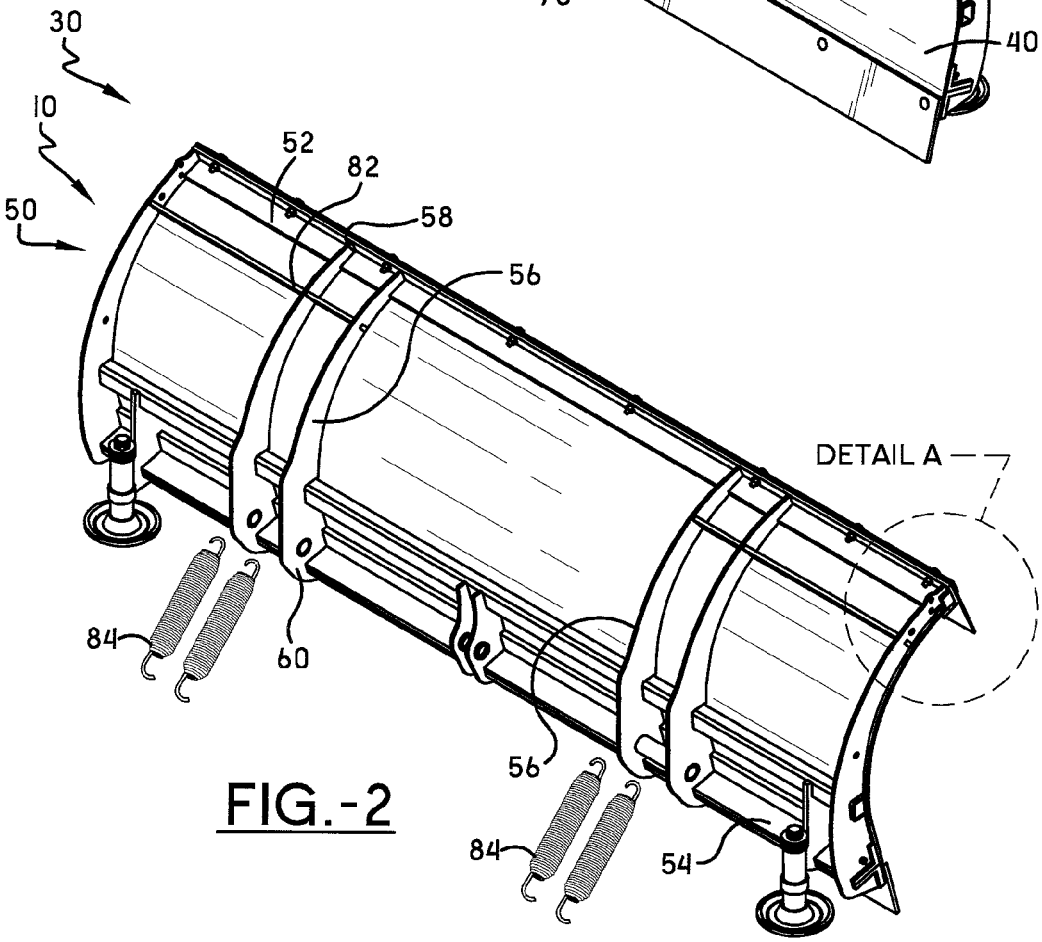
FIG. 2 is a rear perspective view of a snowplow assembly.
Figure 3:
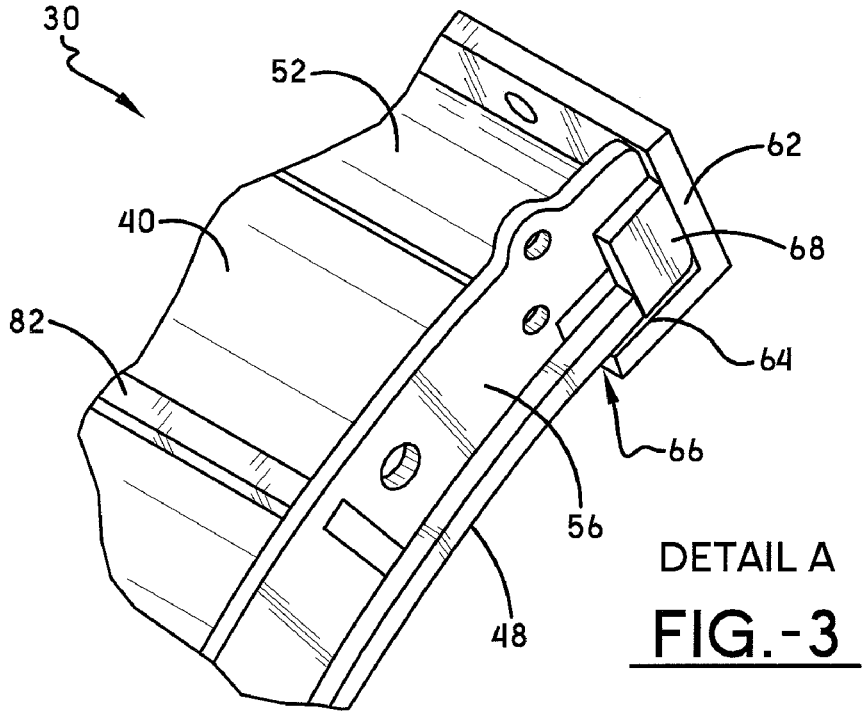
FIG. 3 is an isometric view of Detail A of the snowplow assembly shown in FIG. 2.
Figure 4:
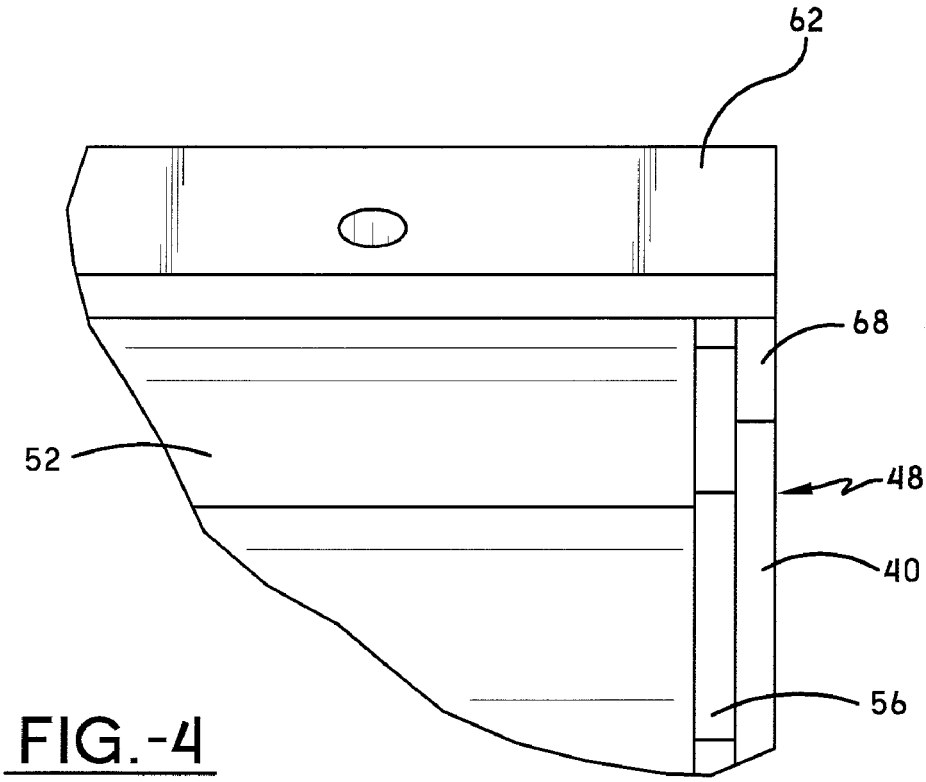
FIG. 4 is a top view of Detail A of the snowplow assembly shown in FIG. 2.
Figure 5:
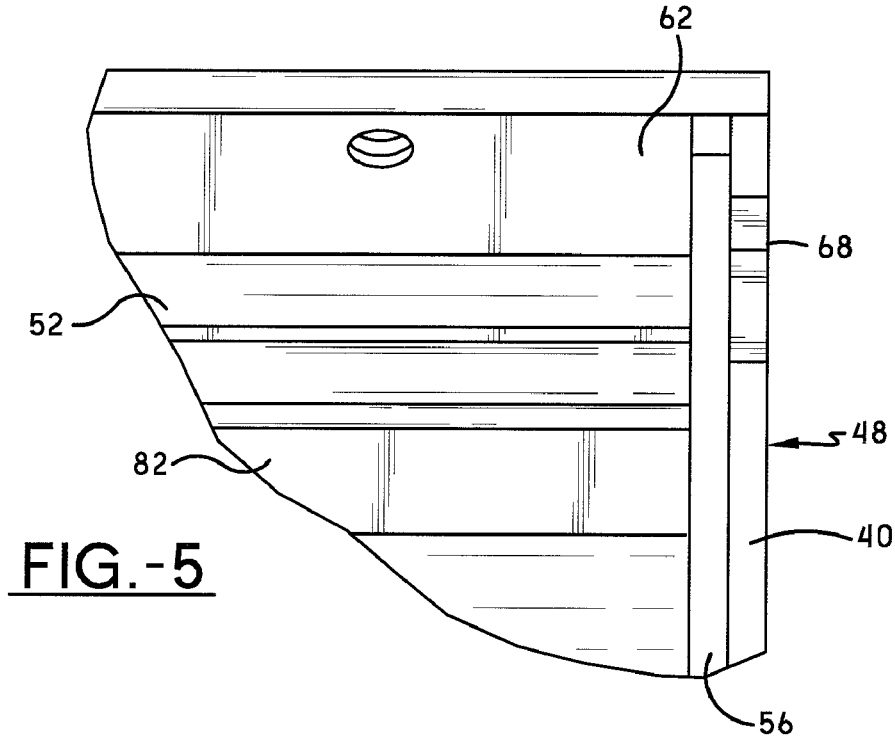
FIG. 5 is rear view of Detail A of the snowplow assembly shown in FIG. 2.
Figure 6:
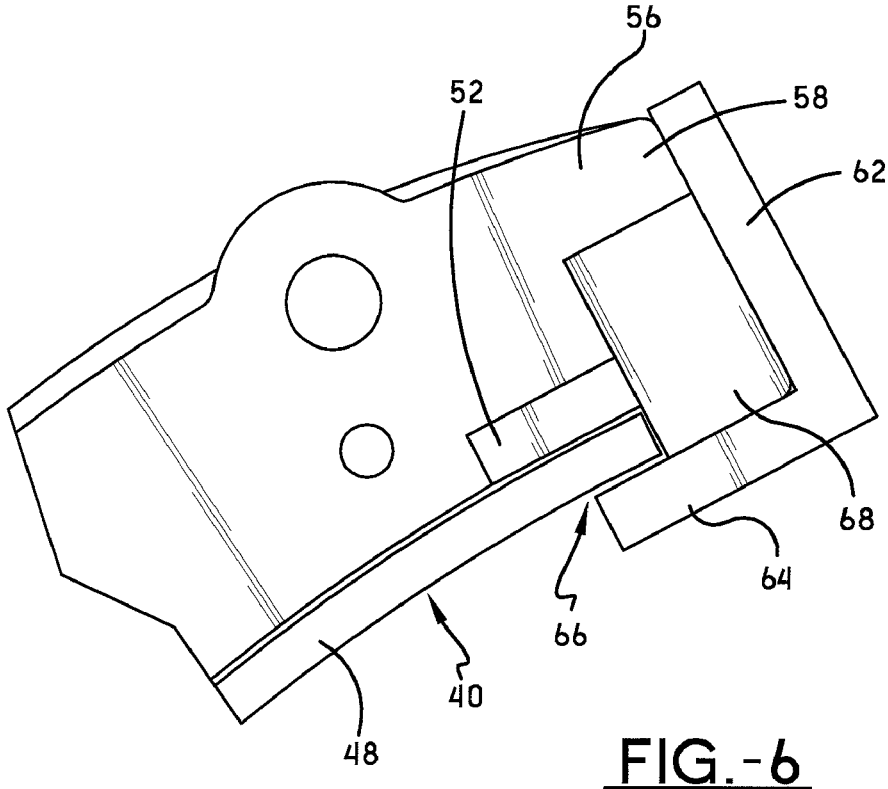
FIG. 6 is a side view of Detail A of the snowplow assembly shown in FIG. 2.

Referring now to the drawings wherein the showings are for purposes of illustrating embodiments of the invention only and not for purposes of limiting the same, and wherein like reference numerals are understood to refer to like components, FIGS. 1 and 2 show a snowplow assembly 10. The snowplow assembly 10 includes a mount assembly (not shown) and a plow blade assembly 30. The mount assembly (not shown) operatively attaches the snowplow assembly 10 to a vehicle (not shown), as is well known in the art. The plow blade assembly 30 may include a curved plow blade or moldboard 40 having a snow engaging surface for use in plowing snow and other frozen or partially frozen precipitation. The moldboard 40 may be formed of plastic, including thermoplastics, including, but limited to, polyethylene, thermosets, or any other material chosen by one with ordinary skill in the art. The plow blade assembly 30 may also include a moldboard frame 50 for receiving the moldboard 40. The moldboard frame 50 may be formed of metal or any other material chosen by one with ordinary skill in the art. The moldboard frame 50 may include a substantially horizontal top member 52 defining a top of the moldboard frame 50, a substantially horizontal bottom member 54 defining a bottom of the moldboard frame 50, and a plurality of spaced apart rib members 56. The rib members 56 may have a first end 58 fixedly attached to the top member 52 and a second end 60 fixedly attached to the bottom member 54, by any means chosen by one with ordinary skill in the art. The snowplow assembly 10 may also include a trip mechanism (not shown), which allows the plow blade assembly 30 to pivot about a substantially horizontal axis. The trip mechanism may include at least one trip spring 84 for biasing the plow blade assembly 30 in a substantially vertical position. The plow blade assembly 30 may include a spring plate 82, shown in FIGS. 2, 3, and 5, for receiving one end of the trip spring 84, as shown in FIG. 2. The snowplow assembly 10 may include a deflector 90 attached near the top of the plow blade assembly 30. In one embodiment, the deflector is attached to the angle member 62 by any means chosen by one with ordinary skill in the art.

With reference now to FIGS. 3-6, 7*a*, and 7*b*, the moldboard frame 50 may also include an angle member 62 attached to the top member 52 by fasteners or by welding, as is well known in the art. Alternatively, the angle member 62 may be attached to the ribs 56 by fasteners or by welding. The angle member 62 may include a first portion 64, which defines a space 66 between the top member 52 and the angle member 62. In an alternate embodiment, the angle member 62 is attached to the bottom member 54, and the first portion 64 defines a space 66 between the bottom member 54 and the angle member 62. The moldboard frame 50 may include a stop member 68 attached to the angle member 62, the top member 52, a rib 56, or any combination of these members by fasteners, welding, or any other means chosen by one with ordinary skill in the art. The stop member 68 may have any shape chosen by one with ordinary skill in the art. In one embodiment, the stop member 68 is substantially rectangular, as shown in FIGS. 7*a* and 7*b*. In another embodiment, the stop member 68 is substantially elliptical.

With reference now to FIGS. 8 and 9, the moldboard 40 may have a general rectangular shape including a top portion 44, a bottom portion 46 and two curvilinear edges 48, 48. The moldboard 40 includes a longitudinal axis extending in the length direction, a transverse axis extending in the width direction, and a transverse axis extending in the thickness direction and substantially perpendicular to the transverse axis extending in the width direction. The moldboard 40 may also include a notch, groove, cutout or recess 42 located near any outside edge. The recess 42 may be located in the top portion 44 of the moldboard 40. In one embodiment, the recess 42 is located in the top portion 44 at the curvilinear edge 48 of the moldboard 40. In a more specific embodiment, one recess 42 is located in the top portion 44 at a first curvilinear edge 48 of the moldboard 40 and another recess 42 is located in the top portion 44 at a second curvilinear edge 48 of the moldboard 40. In another embodiment, the recess 42 is located near the middle or center of the top portion 44 of the moldboard 40. In an alternate embodiment, the recess 42 is located in the bottom portion 46 of the moldboard 40.

With reference now to all the FIGURES, the attachment of the moldboard 40 to the moldboard frame 50 will now be described. In the installed or attached condition, the top portion 44 of the moldboard 40 may be positioned within the space 66 between the first portion 64 of the angle member 62 and the top member 52 of the moldboard frame 50. This position restrains the top portion 44 of the moldboard 40 from movement relative to the moldboard frame 50 along the transverse axis extending in the thickness direction. In addition, the stop member 68 may be positioned within the recess 42. The position of the stop member 68 restrains the top portion 44 of the moldboard 40 from movement relative to the moldboard frame 50 along the longitudinal axis extending in the length direction. Furthermore, the bottom portion 46 of the moldboard 40 may be operatively attached to the moldboard frame 50. In one embodiment, moldboard fasteners 70 attach the bottom portion 46 of the moldboard 40 to the bottom member 54 of the moldboard frame 50. The fasteners 70 may be bolts, screws, rivets, or any other fastener chosen by one with ordinary skill in the art. When the bottom portion 46 is attached to the moldboard frame 50, the top portion 44 is restrained from movement relative to the moldboard frame 50 along the transverse axis extending in the width direction. Additionally, when the bottom portion 46 is attached to the moldboard frame 50, the bottom portion 46 is restrained from movement relative to the moldboard frame 50 in the direction of the longitudinal axis and both transverse axes.

With continuing reference now to all the FIGURES, an alternate embodiment of the attachment of the moldboard 40 to the moldboard frame 50 will now be described. In this alternate embodiment, the angle member 62 is attached to the bottom member 54, and the first portion 64 defines a space 66 between the bottom member 54 and the angle member 62. The bottom portion 46 of the moldboard 40 may be positioned within the space 66 between the first portion 64 of the angle member 62 and the bottom member 54 of the moldboard frame 50. This position restrains the bottom portion 46 of the moldboard 40 from movement relative to the moldboard frame 50 along the transverse axis extending in the thickness direction. In addition, the stop member 68 may be positioned within the recess 42. The position of the stop member 68 restrains the bottom portion 46 of the moldboard 40 from movement relative to the moldboard frame 50 along the longitudinal axis extending in the length direction. Furthermore, the top portion 44 of the moldboard 40 may be operatively attached to the moldboard frame 50. In one embodiment, moldboard fasteners 70 attach the top portion 44 of the moldboard 40 to the top member 52 of the moldboard frame 50. When the top portion 44 is attached to the moldboard frame 50, the bottom portion 46 is restrained from movement relative to the moldboard frame 50 along the transverse axis extending in the width direction. Additionally, when the top portion 44 is attached to the moldboard frame 50, the top portion 44 is restrained from movement relative to the moldboard frame 50 in the direction of the longitudinal axis and both transverse axes.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A snowplow assembly comprising:

a moldboard frame comprising:

a substantially horizontal top member defining a top of the moldboard frame;

a substantially horizontal bottom member defining a bottom of the moldboard frame, the bottom member spaced apart from the top member;

a plurality of spaced apart rib members having a first end fixedly attached to the top member and a second end fixedly attached to the bottom member;

an angle member operatively connected to the top member, wherein a space is defined between a first portion of the angle member and the top member; and, a first stop member operatively connected to the angle member; and, a moldboard formed of polyethylene, the moldboard comprising:

a first recess near a top portion of the moldboard; and, a longitudinal axis, a first transverse axis, and a second transverse axis substantially perpendicular to the first transverse axis;

wherein the top portion of the moldboard is positioned within the space between the first portion of the angle member and the top member for maintaining the position of the moldboard along the first transverse axis in relation to the moldboard frame;

wherein the first stop member is positioned in the first recess for maintaining the position of the moldboard along the longitudinal axis in relation to the moldboard frame; and, wherein a bottom portion of the moldboard is operatively attached to the bottom plate for maintaining the position of the moldboard along the second transverse axis in relation to the moldboard frame.

2. The snowplow assembly of claim 1 wherein the moldboard frame further comprises a second stop member operatively connected to the angle member, the moldboard further comprising a second recess near the top portion of the moldboard, wherein the second stop member is positioned in the second recess for maintaining the position of the moldboard along the longitudinal axis in relation to the moldboard frame.

3. The snowplow assembly of claim 2 wherein the moldboard further comprises a first curvilinear edge and a spaced apart second curvilinear edge, and wherein the first curvilinear edge includes the first recess and the second curvilinear edge includes the second recess.

4. The snowplow assembly of claim 3 wherein the first stop member is fixedly attached to a first end of the first portion of the angle member, and wherein the second stop member is fixedly attached to a second end of the first portion of the angle member.

5. The snowplow assembly of claim 1 wherein a transverse axis of the first portion of the angle member is substantially parallel to a transverse axis of the top member.

6. The snowplow assembly of claim 5 wherein the first stop member is substantially rectangular, the first stop member including a longitudinal axis substantially perpendicular to both the transverse axis of the first portion of the angle member and the transverse axis of the top member.

7. The snowplow assembly of claim 1 wherein the moldboard frame further comprises a spring plate for operatively attaching one end of a trip spring.

8. The snowplow assembly of claim 1 wherein the moldboard is formed of a high-molecular-weight polyethylene.

9. The snowplow assembly of claim 1 further comprising a deflector operatively attached to the top angle.

10. The snowplow assembly of claim 1 further comprising a trip mechanism.

11. A snowplow assembly comprising:

a moldboard frame comprising:

a substantially horizontal top member defining a top of the moldboard frame;

a substantially horizontal bottom member defining a bottom of the moldboard frame, the bottom member spaced apart from the top member;

a plurality of spaced apart rib members having a first end fixedly attached to the top member and a second end fixedly attached to the bottom member;

an angle member operatively connected to the top member, wherein a space is defined between a first portion of the angle member and the top member, and wherein a transverse axis of the first portion is substantially parallel to a transverse axis of the top member;

a first stop member fixedly attached to a first end of the first portion of the angle member; and a second stop member fixedly attached to a second end of the first portion of the angle member; and, a moldboard formed of polyethylene, the moldboard comprising:

first and second recesses near a top portion of the moldboard;

a first curvilinear edge and a spaced apart second curvilinear edge, wherein the first curvilinear edge includes the first recess and the second curvilinear edge includes the second recess; and, a longitudinal axis, a first transverse axis, and a second transverse axis substantially perpendicular to the first transverse axis;

wherein the top portion of the moldboard is positioned within the space between a first portion of the angle member and the top member for maintaining the position of the moldboard along the first transverse axis in relation to the moldboard frame;

wherein the first stop member is positioned in the first recess for maintaining the position of the moldboard along the longitudinal axis in relation to the moldboard frame;

wherein the second stop member is positioned in the second recess for maintaining the position of the moldboard along the longitudinal axis in relation to the moldboard frame; and, wherein a bottom portion of the moldboard is operatively attached to the bottom plate for maintaining the position of the moldboard along the second transverse axis in relation to the moldboard frame.

12. The snowplow assembly of claim 11 wherein the first and second stop members are substantially rectangular, the first and second stop members each including a longitudinal axis substantially perpendicular to both the transverse axis of the first portion of the angle member and the transverse axis of the top member.

13. A method comprising the steps of:

providing a moldboard frame including a substantially horizontal top member defining a top of the moldboard frame, a substantially horizontal bottom member defining a bottom of the moldboard frame, the bottom member spaced apart from the top member, a plurality of spaced apart rib members having a first end fixedly attached to the top member and a second end fixedly attached to the bottom member, an angle member operatively connected to the top member, wherein a space is defined between a first portion of the angle member and the top member, and a first stop member operatively connected to the angle member;

providing a moldboard formed of polyethylene, the moldboard including a first recess near a top portion of the moldboard, a longitudinal axis, a first transverse axis, and a second transverse axis substantially perpendicular to the first transverse axis;

inserting the top portion of the moldboard within the space between the first portion of the angle member and the top member for maintaining the position of the moldboard along the first transverse axis in relation to the moldboard frame;

positioning the top portion of the moldboard so that the first stop member is located within the first recess for maintaining the position of the moldboard along the longitudinal axis in relation to the moldboard frame;

attaching a bottom portion of the moldboard to the bottom plate for maintaining the position of the moldboard along the second transverse axis in relation to the moldboard frame.

14. The method of claim 13 wherein the moldboard frame further comprises a second stop member operatively connected to the angle member, wherein the moldboard further comprising a second recess near the top portion of the moldboard, and wherein the step of positioning the top portion of the moldboard further comprises positioning the top portion of the moldboard so that the second stop member is located within the second recess for maintaining the position of the moldboard along the longitudinal axis in relation to the moldboard frame.

15. The method of claim 14 wherein the moldboard further comprises a first curvilinear edge and a spaced apart second curvilinear edge, and wherein the first curvilinear edge includes the first recess and the second curvilinear edge includes the second recess.

16. The method of claim 15 wherein the first stop member is fixedly attached to a first end of the first portion of the angle member, and wherein the second stop member is fixedly attached to a second end of the first portion of the angle member.

17. The method of claim 13 wherein a transverse axis of the first portion of the angle member is substantially parallel to a transverse axis of the top member.

18. The method of claim 17 wherein the first stop member is substantially rectangular, the first stop member including a longitudinal axis substantially perpendicular to both the transverse axis of the first portion of the angle member and the transverse axis of the top member.

19. The method of claim 13 wherein the moldboard frame further comprises a spring plate for operatively attaching one end of a trip spring.

20. The method of claim 13 wherein the moldboard is formed of a high-molecular-weight polyethylene.

* * * * *